US009604080B2

(12) United States Patent
Langford et al.

(10) Patent No.: US 9,604,080 B2
(45) Date of Patent: Mar. 28, 2017

(54) CARRYING PLATE FOR BREATHING APPARATUS

(71) Applicants: Graham Langford, Merseyside (GB); John Patrick Kearns, Liverpool (GB); Robert C. Sutton, Merseyside (GB)

(72) Inventors: Graham Langford, Merseyside (GB); John Patrick Kearns, Liverpool (GB); Robert C. Sutton, Merseyside (GB)

(73) Assignee: Scott Health & Safety Ltd., Lancashire (GB)

( * ) Notice: Subject to any disclaimer, the term of this patent is extended or adjusted under 35 U.S.C. 154(b) by 213 days.

(21) Appl. No.: 14/509,684

(22) Filed: Oct. 8, 2014

(65) Prior Publication Data

US 2015/0090751 A1 Apr. 2, 2015

Related U.S. Application Data

(63) Continuation of application No. PCT/GB2014/052915, filed on Sep. 26, 2014.

(30) Foreign Application Priority Data

Sep. 27, 2013 (GB) ..... 1317249.9

(51) Int. Cl.

| | |
|---|---|
| ***A45F 3/10*** | (2006.01) |
| ***A62B 9/04*** | (2006.01) |
| *A45F 3/14* | (2006.01) |

(52) U.S. Cl.

CPC ..... *A62B 9/04* (2013.01); *A45F 3/10* (2013.01); *A45F 2003/146* (2013.01); *A45F 2200/00* (2013.01); *A45F 2200/0566* (2013.01)

(58) Field of Classification Search

CPC ..... A62B 9/04; A62B 25/00; B63C 2011/026; A45F 3/10; A45F 3/14–2003/146; A45F 2200/00; A45F 2200/0566

(Continued)

(56) References Cited

U.S. PATENT DOCUMENTS

| | | | | |
|---|---|---|---|---|
| 4,016,616 A * | 4/1977 | Walters | ..... | 405/186 |
| 4,497,069 A * | 2/1985 | Braunhut | ..... | F41H 1/02 2/2.5 |

(Continued)

FOREIGN PATENT DOCUMENTS

| | | |
|---|---|---|
| DE | 29704328 U | 5/1997 |
| WO | 97/43802 | 12/1997 |
| WO | 2014/096797 | 6/2014 |

OTHER PUBLICATIONS

Notification of Transmittal of the International Search Report and the Written Opinion of the International Searching Authority for counterpart application PCT/GB2014/052915, mailed Feb. 23, 2015. (11 pages).

(Continued)

*Primary Examiner* — Justin Larson
*Assistant Examiner* — Scott McNurlen
(74) *Attorney, Agent, or Firm* — Wyatt B. Pratt

(57) ABSTRACT

A mounting assembly for a self-contained breathing apparatus (SCBA) includes a back plate defining a plurality of apertures therein that are arranged in two columns extending down opposing side edges of the back plate. The apertures are sized and spaced to receive mounting straps that are configured to interface with webbing straps of a carrying jacket to fasten the back plate to the jacket. The mounting assembly also includes a tank securing strap with a quick release mechanism that is fastened to the back plate. The tank securing strap is configured to engage a supply tank to releasably fasten the tank to the back plate. The mounting assembly further includes a valve retaining mount disposed on the plate. The valve retaining mount is configured to releasably secure an air supply valve to the back plate for engagement with the supply tank.

15 Claims, 4 Drawing Sheets

(58) Field of Classification Search
USPC ..... 224/628, 633, 907, 934, 261, 582–583, 224/255, 673–675, 901–901.8; 128/205.22; 405/186
See application file for complete search history.

(56) References Cited

U.S. PATENT DOCUMENTS

| | | | | |
|---|---|---|---|---|
| 4,620,653 | A * | 11/1986 | Farrell | A41F 9/002 224/219 |
| 4,979,657 | A * | 12/1990 | Espiritu | B60N 3/103 224/483 |
| 6,186,521 | B1 * | 2/2001 | Divoky | A47D 15/006 280/33.992 |
| D468,792 | S | 1/2003 | Jacoway et al. | |
| 7,490,358 | B1 * | 2/2009 | Beck | 2/2.5 |
| 8,496,149 | B1 * | 7/2013 | Sohm | 224/633 |
| 8,517,636 | B2 * | 8/2013 | Wrigley et al. | 405/186 |
| 8,608,040 | B2 * | 12/2013 | Cheesman et al. | 224/629 |
| 8,695,171 | B2 * | 4/2014 | Colorado | 24/3.7 |
| 2002/0078959 | A1 * | 6/2002 | Haeuser | 128/205.22 |
| 2004/0082238 | A1 | 4/2004 | Jacoway et al. | |
| 2005/0098597 | A1 | 5/2005 | Cottrell et al. | |
| 2009/0229603 | A1 | 9/2009 | Grilliot et al. | |
| 2011/0048421 | A1 * | 3/2011 | Carr et al. | 128/205.22 |
| 2011/0191933 | A1 * | 8/2011 | Gregory et al. | 2/69 |
| 2014/0091124 | A1 * | 4/2014 | Hexels | 224/663 |

OTHER PUBLICATIONS

Combined Search and Examination Report under Sections 17 & 18(3) for application No. GB1417120.1 dated Jan. 23, 2015 (3 pgs.).

* cited by examiner

CARRYING PLATE FOR BREATHING APPARATUS

CROSS-REFERENCE TO RELATED APPLICATIONS

This application is a continuation of and claims priority to International Application No. PCT/GB2014/052915, filed Sep. 26, 2014, which claims priority to Great Britain Patent Application No. GB 1317249.9, filed Sep. 27, 2013, both applications of which are hereby incorporated by reference in their entirety.

BACKGROUND OF THE INVENTION

The subject matter described and/or illustrated herein relates generally to harness plates for carrying breathing apparatuses, such as air tanks and associated equipment.

Self-contained breathing apparatuses (SCBA) are used in a variety of situations where an individual and safe supply of breathable air is required by a user, such as by firefighters entering a smoke filled environment. The equipment includes an air tank, which stores breathable air under pressure, and a regulator valve, which delivers the air to the mouth of the user at a pressure suitable for the user to breath.

Typically, the air tank is large to enable it to hold at least enough air for the user to complete a required task. Due to the large size, the air tank is normally carried on the back of the user. For this purpose, a carrying assembly is coupled to the tank. The carrying assembly includes a rigid plate with a restraining strap that wraps around the air tank to secure the air tank to the plate, typically with the air tank in an outlet down position. The plate also has apertures formed therein. Shoulder and waist harness straps are threaded through the apertures to allow the plate to be carried on the back of the user. The plate and/or harness straps normally include suitable features that enable tubing associated with the SCBA to be routed around and retained in place on the carrying assembly.

Known carrying assemblies may be time consuming to don and remove, which can be a significant issue in certain situations. Furthermore, the shoulder and waist straps may extend tightly around the user, which may restrict both the movement of the user and also the user's accessibility to other equipment on the user's person. Furthermore, in military and civil defence industries, certain specialist users require the use of SCBA while wearing body armour and/op bulletproof vest-type jackets. Many current SCBA's are designed for the firefighting industry and do not integrate very well with other types of body worn equipment in other industries.

A need remains for an SCBA harness mounting system which is better applicable for use in specialist applications than known SCBA harness mounting systems. A need also remains for a mounting assembly which can integrate directly with existing webbing and body armour used in specialist applications.

BRIEF DESCRIPTION OF THE INVENTION

In an embodiment, a mounting assembly for a self-contained breathing apparatus (SCBA) is provided that includes a back plate having a plurality of apertures formed therein. The apertures are arranged in two columns extending down opposing side edges of the back plate. The apertures are sized and spaced to receive and engage mounting straps. The mounting straps are configured to interface with webbing straps of a carrying jacket to fasten the back plate to the jacket. The mounting assembly also has tank securing strap fastened to the back plate. The tank securing strap is configured to engage a supply tank to securely and releasably fasten the tank to the back plate. The mounting assembly further has valve retaining mount configured to releasably secure an air supply valve to the back plate for engagement with the supply tank.

The mounting assembly in accordance with one or more embodiments has the advantage that the back plate is securable directly to a jacket normally worn by a user, such as a body armour jacket or the like. Therefore, the mounting assembly avoids the restrictions in movement and limited accessibility to equipment that are associated with known mounting assembly designs. Furthermore, due to the releasability of the tank securing strap and the valve retaining mount, the SCBA equipment (tank and valve assembly) may easily and quickly be dumped by the user, if circumstances necessitate, without having to remove or discard the jacket.

In an embodiment, the apertures in the back plate are configured to interface with and/or couple to the user's clothing using a method of MOLLE attachment (Modular Light Weight Load Carrying Equipment). MOLLE attachment uses an interlocking weave of vertical and horizontal webbing that secures one item to another. In an embodiment, each column of apertures has a fastening strap woven through the apertures of that column and secured at the top and bottom of the plate. Each of the straps may be configured to be engageable through horizontal MOLLE straps of the webbing so as to hang the back plate on the webbing.

In an embodiment, at least one of the top or the bottom of each of the straps, such as the bottom of the straps for example, is attached to the back plate by a quick release system, such as via press studs. In this way a wearer can easily jettison the back plate and any apparatus mounted thereon without third party assistance by simply releasing the attachment of the straps from the back plate and allowing the weight of the back plate and the apparatus mounted thereon to cause the straps to un-weave from the MOLLE straps.

In an embodiment, at least one of the tank securing strap and the valve retaining mount has a quick release mechanism or operation associated therewith. Thus, when the tank securing strap and/or the valve retaining mount are not required, the user can quickly and easily remove the valve and associated supply lines, as well as the tank, from the back plate, leaving the only back plate attached to the user's jacket or other clothing.

In an embodiment, the valve retaining mount provides a bayonet type coupling for fastening an air supply valve to the back plate. For example, the valve retaining mount may be a system that requires relative rotation of substantially 90 degrees between the air supply valve and the back plate in order for the valve to secure to and release from the back plate.

The back plate may be made of light weight material, such as carbon fibre or polymeric material, with a low profile. Fastened to the back plate are specialist mountings which allow pneumatics to be quickly mounted to the back plate, even for multiple tank sizes.

Pipe retainers may also be provided on the back plate. The pipe retainers are configured to retain and/or secure in place pipes, tubes, and/or hoses that are associated with a valve assembly in order to route the hoses from the air supply valve to a defined or designated location that is accessible to the user during operation.

BRIEF DESCRIPTION OF THE DRAWINGS

Reference is made to the accompanying drawings in which particular embodiments and further benefits of the inventive subject matter are illustrated as described in more detail in the description below, in which.

DETAILED DESCRIPTION OF THE INVENTION

Figure 1:
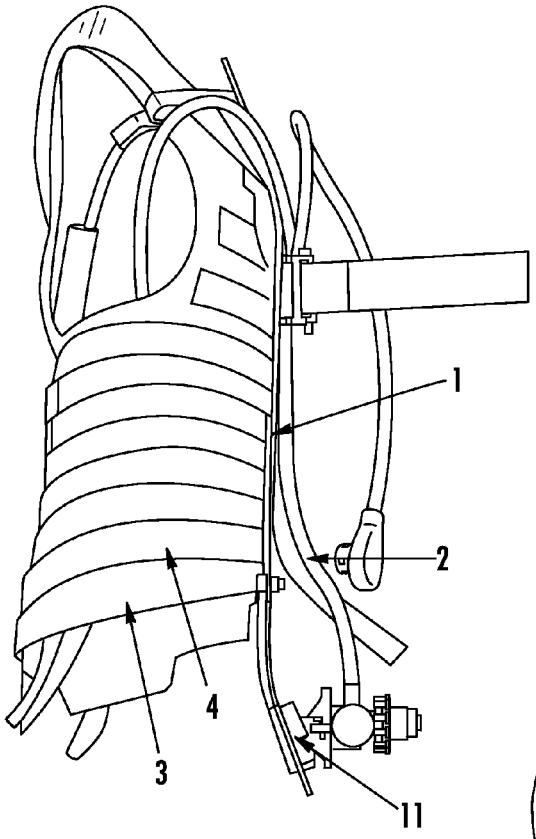
FIG. 1 is a side view of a bullet proof jacket with a mounting assembly formed in accordance with an embodiment.
Figure 2:
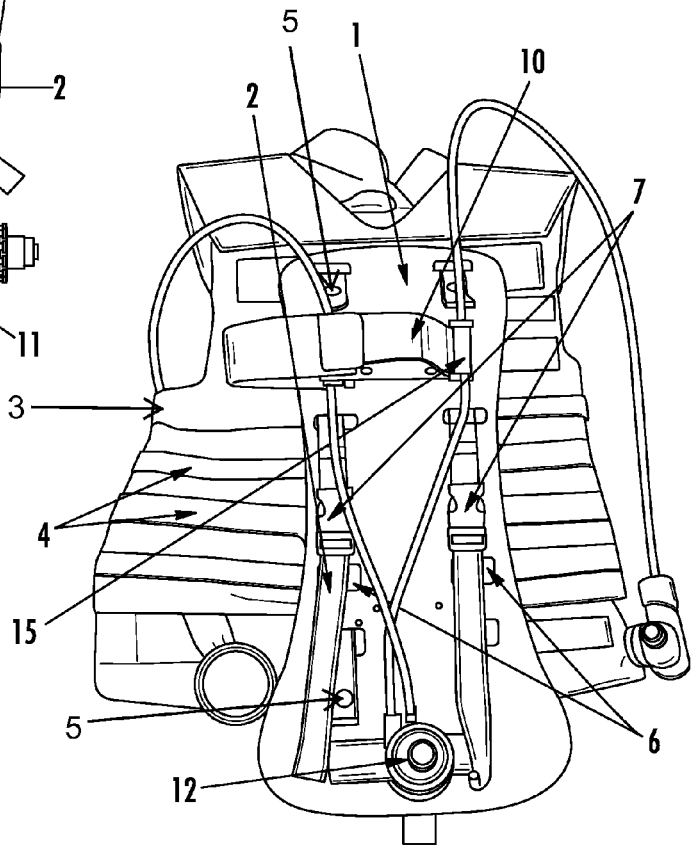
FIG. 2 is a back view of the jacket of FIG. 1.

FIG. 1 is a side view of a bullet proof jacket with a mounting assembly formed in accordance with an embodiment. The mounting assembly includes a back plate 1 mounted by MOLLE straps 2 to a body armour jacket 3. The jacket 3 has horizontal webbing straps 4 which extend around the jacket 3. The webbing straps 4 are fastened to the jacket 3 at aligned intervals, forming aligned points or gaps at which the MOLLE straps 2 may be fed vertically through the webbing straps 4 between each strap and the jacket 3. Referring now to FIG. 2, the MOLLE straps 2 are attached to the back plate 1 at the top and bottom by press studs 5. The press studs 5 enable the user to easily detach the top and/or bottom of each MOLLE strap 2 from the back plate 1 to release the back plate 1 and any equipment mounted thereon from the jacket 3 while wearing the jacket 3. Although press studs 5 are shown in FIG. 2, it is understood that other releasable fasteners for fastening the MOLLE straps 2 to the back plate 1 may be used.

Figure 3:
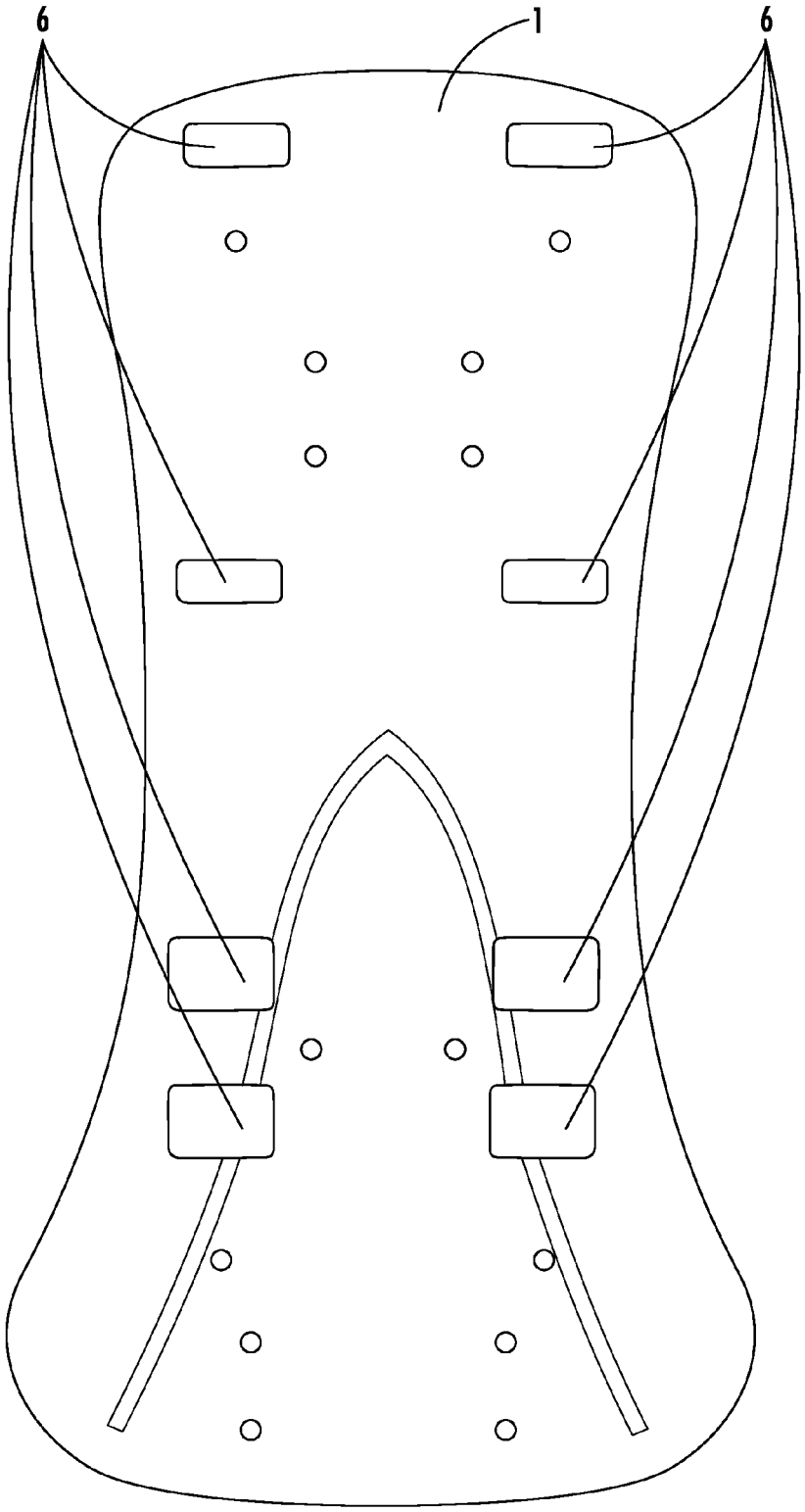
FIG. 3 is a rear view of a back plate which forms part of the assembly of FIG. 1.

Referring now to both FIG. 2 and FIG. 3, the back plate 1 has apertures 6 formed therein. The MOLLE straps 2 may be weaved through the apertures 6 in order to fasten the back plate 1 to the jacket 3. Each MOLLE strap 2 may be secured in place by a buckle 7 to facilitate quick attachment and removal of the back plate 1 from the jacket 3 if required or desired.

With reference now back to FIGS. 1 and 2, the back plate 1 also has a tank strap 10 that is mounted towards the top of the back plate 1. In addition, the back plate 1 has an air supply valve mount 11 that is provided towards the bottom of the back plate 1. The tank strap 10 and/or the valve mount 11 may have a quick release mechanism or operation. In an embodiment, the valve mount 11 includes a bayonet type coupling configured to interface with an air supply valve 12 to attach the air supply valve 12 to the back plate 1. The bayonet type coupling may require a 90 degree turn of the air supply valve 12 in one direction relative to the back plate 1 to secure the air supply valve 12 to the back plate 1, and a 90 degree turn in the opposite direction to release the air supply valve 12 from the plate 1. The details of the bayonet type coupling are known in the art and will not be described in further detail herein.

The valve mount 11 secures the air supply valve 12 to the back plate 1. The valve mount 11 is configured to be located in a position on the back plate 1 that allows the air supply valve 12 coupled thereto to automatically locate or align with an air valve or outlet disposed on the top of an air tank (not shown) that is mounted onto the back plate 1 and secured in place with the tank strap 10. The air supply valve 12 may include a fastener for coupling or sealing the air supply valve 12 to the air outlet of the air tank.

The back plate 1 may also include pipe retainers 15. The pipe retainers 15 are configured to route supply tubes or pipes from the air supply valve 12 to one or more designated operational positions, such as positions that are accessible to the user while the user is wearing the jacket.

Figure 4:
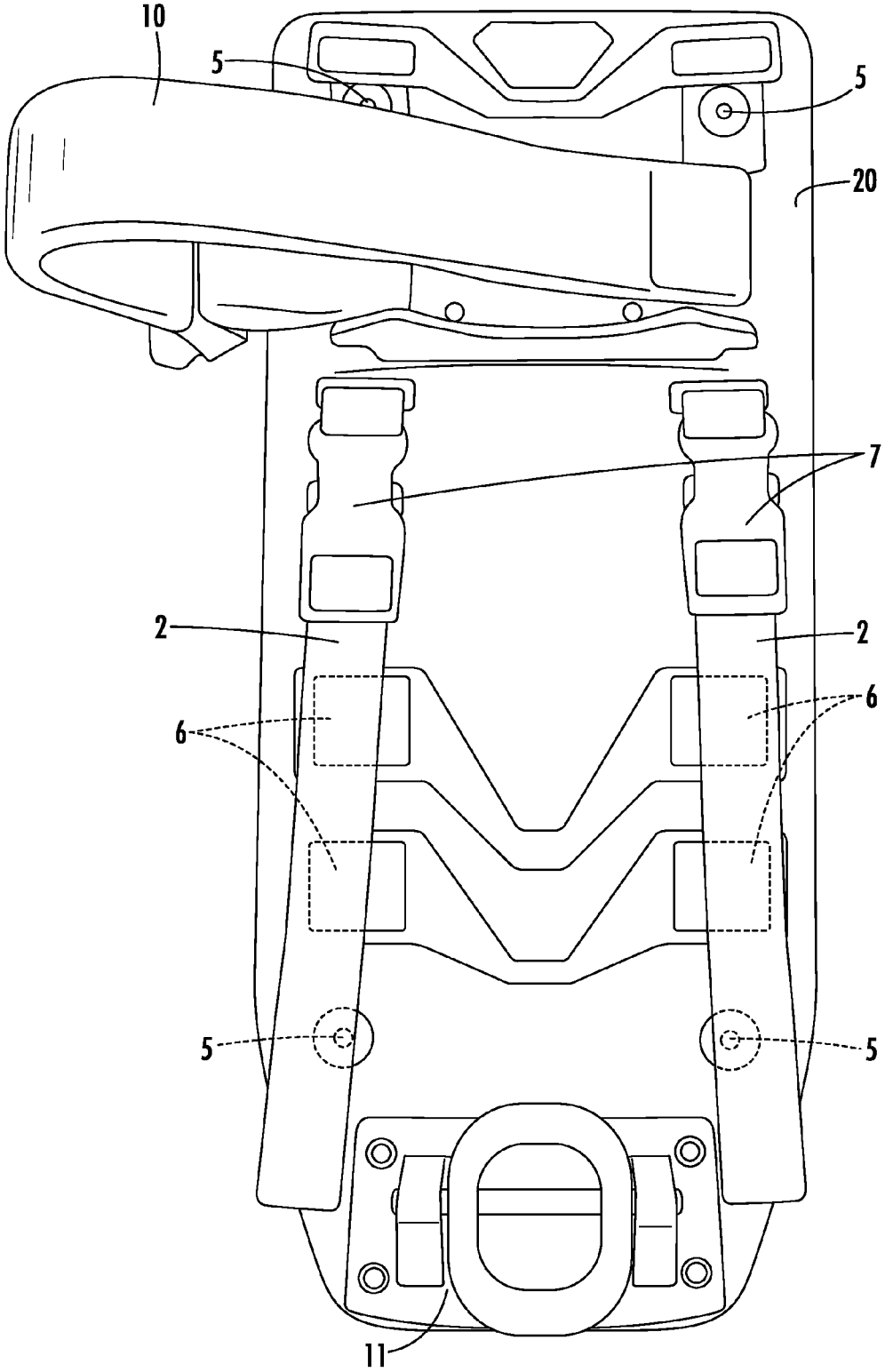
FIG. 4 is a rear view of a mounting assembly according to another embodiment.
Figure 5:
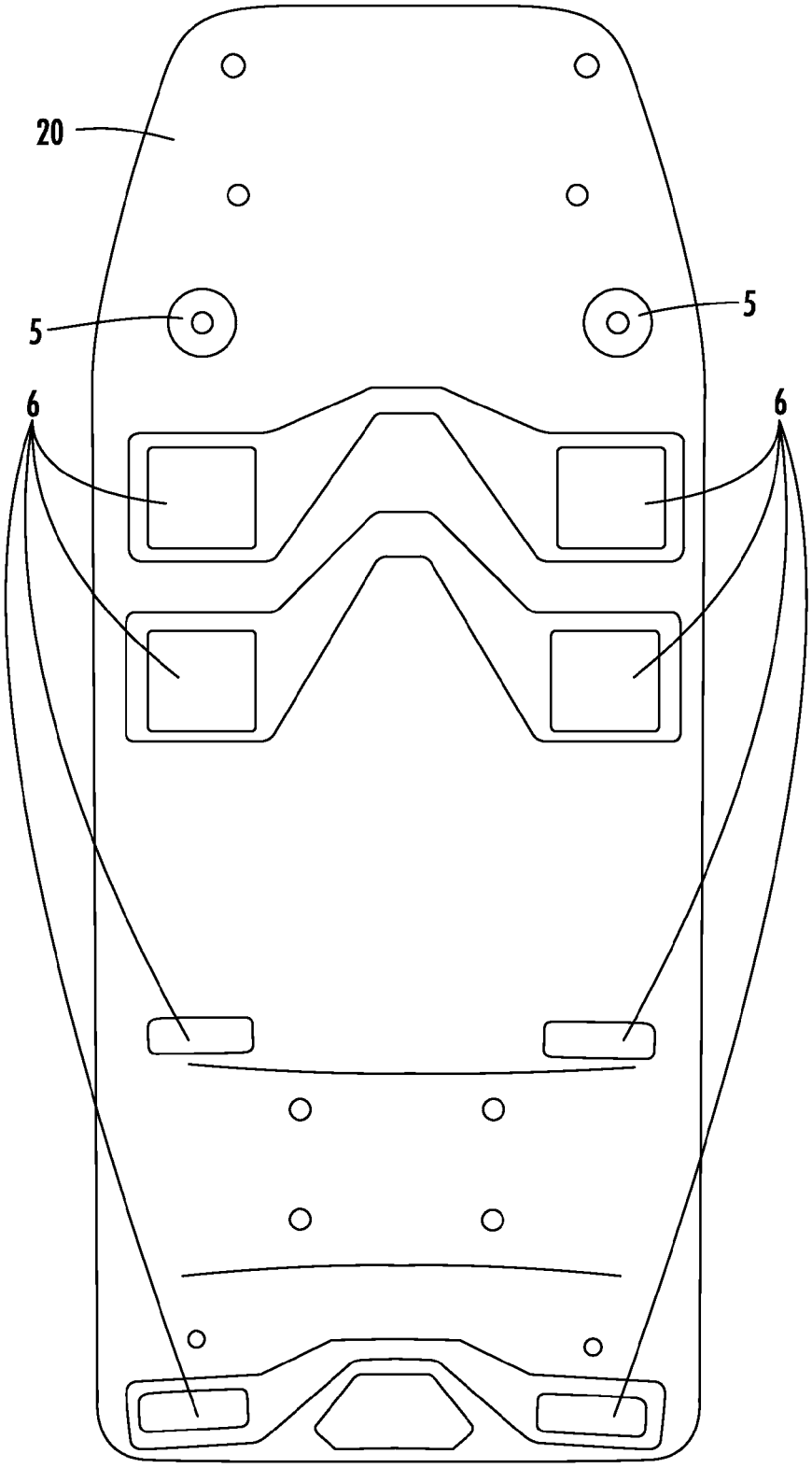
FIG. 5 is a rear view of a back plate which forms part of the mounting assembly of FIG. 4.

FIG. 4 is a rear view of a mounting assembly according to another embodiment. FIG. 5 is a rear view of a back plate which forms part of the mounting assembly of FIG. 4. In the embodiment of the mounting assembly shown in FIGS. 4 and 5, like features are identified using the same reference numerals as the embodiment of the mounting assembly shown in FIGS. 1-3. The mounting assembly in FIGS. 4 and 5 includes a back plate 20 that is configured in a similar manner to that of the back plate 1 shown in FIGS. 1-3 except that the shape has been changed to provide potentially a more comfortable fit for the wearer. The back plate 20 has apertures 6 arranged in two columns, with one column extending down each side edge of the back plate 20. MOLLE straps 2 may be woven through the apertures 6 (or through the columns of apertures 6) in order to secure the back plate 20 to webbing straps of a carry jacket. Each MOLLE strap 2 may be secured to the back plate 20 at top and bottom ends by press studs 5. The press studs 5 enable quick release of the MOLLE straps 2, such as when it is required to dump the back plate 20 and any apparatus mounted thereon.

The back plate 1, 20 (according to either embodiment) is configured to be used with a jacket having horizontally extending webbing straps distributed vertically down the jacket. Each webbing strap may have portions that are not connected to the jacket, defining slots or gaps, which enables vertical straps to be threaded between the webbing straps and the jacket. The back plate 1, 20 may be connected to the jacket by: threading a first connecting end of a MOLLE strap 2 to the top press stud 5 on the respective plate 1, 20; passing the MOLLE strap 2 through one aperture 6 of one of the columns on the respective plate 1, 20: feeding the MOLLE strap 2 between one of the webbing straps and the jacket; feeding the MOLLE strap 2 up through the next aperture 6 in the column and back down the subsequent aperture 6 in the column; feeding the MOLLE strap 2 between another of the webbing straps and the jacket; and continuing on until the MOLLE strap 2 has been fed through the last aperture 6. Once the MOLLE strap 2 has been fed through the last aperture 6, a second end is fastened to a lower press stud 5. The process is repeated with a second MOLLE strap 2 being fed through the apertures 6 of the second column. The back plates 1, 20 thus may be secured to the jacket using the MOLLE straps 2.

In an embodiment, after securing the back plate 1, 20 to the jacket, an air supply valve 12 (shown in FIG. 2) may be secured to the valve mount 11 by engaging the coupling parts and turning the supply valve 12 through 90 degrees to lock the supply valve 12 to the valve mount 11. Supply pipes, configured to convey air to and/or from the user, may be fed through pipe retainers 15 to hold the supply pipes in place. Finally, an air tank may be inserted through the tank strap 10 such that an air outlet of the air tank engages the supply valve 12. The tank strap 10 is subsequently tightened to lock or secure the air tank to the back plate 1, 20. Optionally, each of these steps may be performed by the user before donning the jacket or may be performed by a helper while the user is wearing the jacket.

In an embodiment, the user has at least three options for removing equipment during use. First, the air tank may be removed by disconnecting the air outlet from the air supply valve 12 (shown in FIG. 2) and then releasing the tank strap 10. The air tank may then be lifted off of the back plate 1, 20, leaving the back plate 1, 20, with the supply valve 12 coupled thereto, in place attached to the jacket. This option may be performed by the wearer on his or her own after first removing the jacket or may be performed with assistance from another person while the jacket is still being worn by the wearer.

A second option is to remove both the air tank and the air supply valve 12 (shown in FIG. 2) together. The supply valve 12 is released by rotating the supply valve 12 a 90 degree turn relative to the valve mount 11 to disconnect it from the valve mount 11. Then, the tank strap 10 may be released to disconnect the air tank from the back plate 1, 20. The air tank with the supply valve 12 still attached may then be removed from the back plate 1, 20, leaving the plate 1, 20 attached to the jacket. Again, this second option may be performed by the wearer on his or her own by first removing the jacket or with assistance of another person while the jacket is still being worn by the wearer. This second option may be quicker than the first option and/or may relieve more weight than the first option.

In an emergency situation, a third option for the user is to dump or remove the back plate 1, 20 from the jacket while the air tank and air supply valve 12 (shown in FIG. 2) are both still attached to the back plate 1, 20 so as to completely remove all of the equipment from the jacket. This option may be performed by the wearer without removing the jacket and without third party assistance by simply reaching behind and releasing the press studs 5 at either the top or the bottom of each MOLLE strap 2. Once the MOLLE straps 2 are released, the weight of the air tank causes the MOLLE straps 2 to pull out of the apertures 6 and webbing straps, dropping the back plate 1, 20 off of the jacket.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. A mounting assembly for a self-contained breathing apparatus (SCBA) comprising:

a back plate including an inner side and an opposite outer side and defining a plurality of apertures that extend through the back plate between the inner side and the outer side, the apertures being arranged in at least two columns extending generally parallel to side edges of the back plate, the apertures in each column being sized and spaced to receive a mounting strap woven therethrough that is configured to interface with webbing straps of a carrying jacket of a user to fasten the back plate to the jacket, the inner side of the back plate facing the jacket when the back plate is fastened to the jacket, the back plate further including at least one quick release fastener associated with each of the columns of apertures, each quick release fastener being disposed on the outer side of the back plate and configured to engage an end of the corresponding mounting strap to releasably secure the mounting strap to the back plate, the at least one quick release fastener associated with each of the columns of apertures including a first quick release fastener disposed vertically between two adjacent apertures in the corresponding column;

a tank securing strap fastened to the back plate, the tank securing strap configured to engage a supply tank to securely and releasably fasten the tank to the back plate; and a valve retaining mount disposed on the back plate, the valve retaining mount configured to releasably secure an air supply valve to the back plate for engagement with the supply tank.

2. The mounting assembly of claim 1, wherein the apertures in the back plate are configured to interface with the jacket of the user using a MOLLE (Modular Light Weight Load Carrying Equipment) attachment method.

3. The mounting assembly of claim 1, wherein the at least one quick release fastener is a press stud.

4. The mounting assembly of claim 1, wherein the tank securing strap includes a quick release mechanism configured to release the tank securing strap from the back plate.

5. The mounting assembly of claim 1, wherein the valve retaining mount includes a quick release mechanism configured to release the valve retaining mount from the back plate.

6. The mounting assembly of claim 1, wherein the valve retaining mount includes a bayonet type coupling for fastening the air supply valve to the back plate.

7. The mounting assembly of claim 6, wherein the bayonet type coupling of the valve retaining mount requires a 90 degree turn of the air supply valve in a first direction relative to the back plate to secure the air supply valve to the back plate, and a 90 degree turn of the air supply valve in an opposite second direction to release the air supply valve from the back plate.

8. The mounting assembly of claim 1, further including pipe retainers disposed on the back plate, the pipe retainers configured to retain hoses associated with the air supply valve in place on the back plate and configured to route the hoses from the air supply valve to one or more designated locations that are accessible to the user while wearing the jacket.

9. The mounting assembly of claim 1, wherein each column of apertures in the back plate includes at least one aperture disposed vertically above the tank securing strap and multiple apertures disposed vertically below the tank securing strap and above the valve retaining mount.

10. The mounting assembly of claim 1, wherein the at least one quick release fastener associated with each of the columns of apertures includes a first quick release fastener disposed vertically above the tank securing strap for releasably coupling a top end of the corresponding mounting strap to the back plate and a second quick release fastener disposed vertically below the tank securing strap and above the valve retaining mount for releasably coupling a bottom end of the corresponding mounting strap to the back plate.

11. A method for mounting a self-contained breathing apparatus (SCBA) to a jacket of a user using a mounting assembly, the method comprising:

connecting a back plate to the jacket by interweaving mounting straps through apertures that extend through the back plate and around webbing straps connected to the jacket, the back plate extending vertically between a top and a bottom, the apertures being arranged in at least two columns oriented vertically between the top and the bottom of the back plate, a top end of each mounting strap being releasably coupled to the back plate via a respective first press stud associated with one of the columns and located proximate to the top of the back plate, a bottom end of each mounting strap being releasably coupled to the back plate via a respective second press stud associated with one of the columns and located proximate to the bottom of the back plate;

releasably securing an air supply valve to a valve retaining mount disposed on the back plate;

inserting an air tank through a tank securing strap, the air supply valve being secured by the valve retaining mount in a position aligned with an air outlet of the air tank to allow the air supply valve to engage the air outlet; and tightening the tank securing strap around the air tank to secure the air tank to the back plate and to the jacket;

wherein connecting the back plate to the jacket includes:

releasably coupling the top end of a first mounting strap of the mounting straps to the first press stud in a first column, the first press stud being held on an outer side of the back plate that is opposite an inner side of the back plate, the inner side facing the jacket when the back plate is fastened to the jacket;

threading the first mounting strap through a first aperture of the apertures in the first column from the outer side of the back plate to the inner side of the back plate, the first aperture being disposed above the first press stud;

feeding the first mounting strap around a first webbing strap of the jacket;

threading the first mounting strap through a second aperture in the first column that is disposed adjacent to the first aperture and below the first press stud such that the first mounting strap extends from the inner side to the outer side, and then through a third aperture of the apertures that is disposed adjacent to the second aperture in the first column such that the first mounting strap extends from the outer side to the inner side;

feeding the first mounting strap around a second webbing strap of the jacket; and coupling the bottom end of the first mounting strap to the second press stud proximate to the bottom of the back plate.

12. The method of claim 11, wherein the first column of apertures through which the first mounting strap is threaded is a right column, the method further including alternately threading a second mounting strap of the mounting straps through apertures arranged in a left column and feeding the second mounting strap around the webbing straps of the jacket to support the connection between the back plate and the jacket.

13. The method of claim 11, wherein the valve retaining mount includes a bayonet type coupling that requires a 90 degree turn of the air supply valve in a first direction relative to the back plate to secure the air supply valve to the back plate, and a 90 degree turn of the air supply valve in an opposite second direction to release the air supply valve from the back plate.

14. The method of claim 11, further comprising securing one or more hoses extending from the air supply valve to the back plate using pipe retainers disposed on the back plate and routing the one or more hoses to one or more designated locations that are accessible to the user while wearing the jacket.

15. A mounting assembly for a self-contained breathing apparatus (SCBA) comprising:

a back plate including an inner side and an opposing outer side and defining a plurality of apertures that extend through the back plate between the inner side and the outer side, the apertures being arranged in at least two columns extending generally parallel to side edges of the back plate;

at least two mounting straps extending between respective top and bottom ends, each mounting strap being woven through the apertures in a corresponding one of the columns, the top and bottom ends of each mounting strap being releasably secured to the back plate via upper and lower press studs, respectively, that are associated with each of the columns of apertures, the upper and lower press studs being disposed on the outer side of the back plate, the upper press stud associated with a corresponding column being disposed between two adjacent apertures in the column, a portion of each mounting strap extending upwards from the upper press stud through a top aperture in the corresponding column, the top aperture being most proximate to a top of the back plate relative to the other apertures in the column, the mounting straps being configured to engage webbing straps of a carrying jacket of a user to fasten the back plate to the carrying jacket, the inner side of the back plate facing the jacket when the back plate is fastened to the jacket;

a tank securing strap fastened to the back plate, the tank securing strap configured to engage a supply tank to securely and releasably fasten the tank to the back plate; and a valve retaining mount disposed on the back plate, the valve retaining mount configured to releasably secure an air supply valve to the back plate for engagement with the supply tank.

* * * * *